US010149582B1

(12) United States Patent
Eddings et al.

(10) Patent No.: US 10,149,582 B1
(45) Date of Patent: Dec. 11, 2018

(54) AUTOMATED TOILET SEAT ACTUATOR AND ASSOCIATED USE THEREOF

(71) Applicant: John Carson Eddings, Atlantic Beach, FL (US)

(72) Inventors: John Carson Eddings, Atlantic Beach, FL (US); Mike Ferran, Jacksonville, FL (US)

(73) Assignee: John Carson Eddings, Atlantic Beach, FL (US)

( * ) Notice: Subject to any disclaimer, the term of this patent is extended or adjusted under 35 U.S.C. 154(b) by 0 days.

(21) Appl. No.: 15/709,175

(22) Filed: Sep. 19, 2017

Related U.S. Application Data

(60) Provisional application No. 62/477,673, filed on Mar. 28, 2017.

(51) Int. Cl.
*A47K 13/10* (2006.01)
*H01H 35/18* (2006.01)

(52) U.S. Cl.
CPC ..... *A47K 13/10* (2013.01); *H01H 35/18* (2013.01)

(58) Field of Classification Search
CPC ..... A47K 13/10
USPC ..... 4/246.1–246.5
See application file for complete search history.

(56) References Cited

U.S. PATENT DOCUMENTS 5,307,524 A * 5/1994 Veal ..... E03D 5/10 4/246.1
5,570,478 A * 11/1996 Armstrong ..... A47K 13/10 4/246.1
6,941,588 B1 * 9/2005 Oprandi ..... A47K 13/10 4/246.1

* cited by examiner

*Primary Examiner* — Christine Skubinna
(74) *Attorney, Agent, or Firm* — Ashkan Najafi

(57) ABSTRACT

An automated toilet seat actuator includes a housing, a water-level detection mechanism located exterior of the housing and configured to learn when a real-time water level in the existing toilet tank fluctuates below and above a predetermined minimum threshold water level. An actuation mechanism is in communication with the water-level detection mechanism and the existing toilet seat. A processor is in communication with the actuation mechanism and the water-level detection mechanism. A memory is in communication with the processor and includes software instructions which operably bias the actuation mechanism between a retracted position and an extended position upon learning that the real-time water level has dropped below the predetermined minimum threshold water level.

17 Claims, 13 Drawing Sheets

AUTOMATED TOILET SEAT ACTUATOR AND ASSOCIATED USE THEREOF

CROSS REFERENCE TO RELATED APPLICATIONS

This is a non-provisional patent application that claims the benefit of U.S. provisional patent application No. 62/477,673 filed Mar. 28, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to toilet accessories and, more particularly, to a portable, automated toilet seat actuator that is operably positioned at a toilet tank for selectively articulating a toilet seat from a raised position to a lowered position when the toilet is flushed.

Prior Art

Since the development of the hinged toilet seat, there has been an ongoing problem between men and women who use the same toilets. The hinged seat was developed for sanitary reasons, to allow men, who naturally urinate while standing, to do so without inadvertently wetting the seat. After finishing, the tendency is to leave the seat in the upright position. Women, who always use toilets with the seat in the lowered position, have seen this as inconsiderate or worse on the part of men, and men are constantly reminded by women to return the seat to the lowered position after using a toilet. Even so, it can be difficult for a male to remember to do so under all circumstances.

Adults, particularly women, have complained for years that men users of toilets leave the toilet seat of a toilet in an upright position. At times, women users of a toilet have rushed into the bathroom and have fallen into the commode with a shocking splash. Men, even though told to lower the toilet seat of the toilet after urinating, have forgotten, and the problem of women falling into the commode continues to happen. One thing most adult men users do remember to do is to flush the toilet. For children and animals, it is highly undesirable for them to get in the commode.

For safety reasons, it is desirable to have the toilet seat cover and seat in a closed position after use to prevent small children, pets and household articles from falling into the toilet. Even adults may be subjected to inconvenience, trauma, possible injury, and understandable irritation in attempting to use a toilet in the dark, thinking the seat is down when it is not. Additionally, it is esthetically desirable to have the toilet seat and cover in a closed position when not in use.

Accordingly, a need remains for a toilet seat actuator in order to overcome at least one of the above-noted shortcomings. The exemplary embodiment(s) satisfy such a need by a portable, automated toilet seat actuator that is operably positioned at a toilet tank, and which is convenient and easy to use, lightweight yet durable in design, versatile in its applications, and designed for selectively articulating a toilet seat from a raised position to a lowered position when the toilet is flushed. The present disclosure automatically closes the toilet seat and cover upon activation of the toilet flushing lever, thereby insuring that both the seat and cover are in a closed position when not in use.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide an automated toilet seat actuator operably positioned at an existing toilet tank for selectively articulating an existing toilet seat from a raised position to a lowered position when the existing toilet tank is flushed. These and other objects, features, and advantages of the non-limiting exemplary embodiment(s) are provided by an automated toilet seat actuator including a portable housing removably engaged with the existing toilet tank and including a bottom section and a cover pivotally coupled thereto, and a water-level detection mechanism located exterior of the housing. Such a water-level detection mechanism is configured to learn when a real-time water level in the existing toilet tank fluctuates below and above a predetermined minimum threshold water level (as further described below). An actuation mechanism is disposed within the housing and is in communication with the water-level detection mechanism and the existing toilet seat. A processor is disposed within the housing and is in communication with the actuation mechanism and the water-level detection mechanism. A power source is disposed within the housing and is in communication with the actuation mechanism and the processor. A memory is disposed within the housing and is in communication with the processor. Such a memory includes software instructions, when executed by the processor, which operably bias the actuation mechanism between a retracted position and an extended position upon learning that the real-time water level has dropped below the predetermined minimum threshold water level.

In a non-limiting exemplary embodiment, the cover is detachably coupled to the housing.

In a non-limiting exemplary embodiment, the water-level detection mechanism includes a variable float switch communicatively coupled to the processor. Such a variable float switch is capable of being seated within the existing toilet tank.

In a non-limiting exemplary embodiment, the variable float switch linearly reciprocates along a vertical travel path relative to a horizontal water level within the existing toilet tank.

In a non-limiting exemplary embodiment, the water-level detection mechanism includes a sensor in communication with the processor. Such a sensor is capable of determining when a water level in the toilet tank rises and falls.

In a non-limiting exemplary embodiment, the cover pivots about a first fulcrum axis relative to the bottom section. Such an actuation mechanism includes: a servo motor and a servo cam operably coupled thereto, a bearing mount operably coupled to the servo cam, and a bearing operably coupled to the bearing mount. In this manner, the servo cam is rotatably displaced (articulated) about a second fulcrum axis such that the bearing mount and bearing are generally centered at an interior face of cover during articulation of the cover. In particular, the bearing engages the interior face of cover thereby pivoting it to the open position and thereafter allowing it to return to the closed position.

In a non-limiting exemplary embodiment, the first fulcrum axis is registered parallel to the second fulcrum axis.

In a non-limiting exemplary embodiment, the water-level detection mechanism is statically coupled to the bottom section.

In a non-limiting exemplary embodiment, the water-level detection mechanism is adjustably tethered to the processor.

The present disclosure further includes a method of utilizing an automated toilet seat actuator for selectively articulating an existing toilet seat from a raised position to a lowered position when an existing toilet tank is flushed. Such a method includes the steps of: obtaining an existing toilet tank; and providing and operably positioning an automated toilet seat actuator at the existing toilet tank by performing the sub-steps of: providing a portable housing including a bottom section and a cover pivotally coupled thereto; providing and locating a water-level detection mechanism exterior of the housing; providing and disposing an actuation mechanism within the housing such that the actuation mechanism is in communication with the water-level detection mechanism and the existing toilet seat; providing and disposing a processor within the housing such that the processor is in communication with the actuation mechanism and the water-level detection mechanism; providing and disposing a memory within the housing such that the memory is in communication with the processor; providing and disposing a power source within the housing such that the power source is in communication with the actuation mechanism and the processor; and removably engaging the portable housing with the existing toilet tank.

The method further includes the steps of: flushing the existing toilet tank, the water-level detection mechanism learning when a real-time water level in the existing toilet tank fluctuates below and above a predetermined minimum threshold water level; and the memory including software instructions, when executed by the processor, operably biasing the actuation mechanism between a retracted position and an extended position upon learning that the real-time water level has dropped below the predetermined minimum threshold water level.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
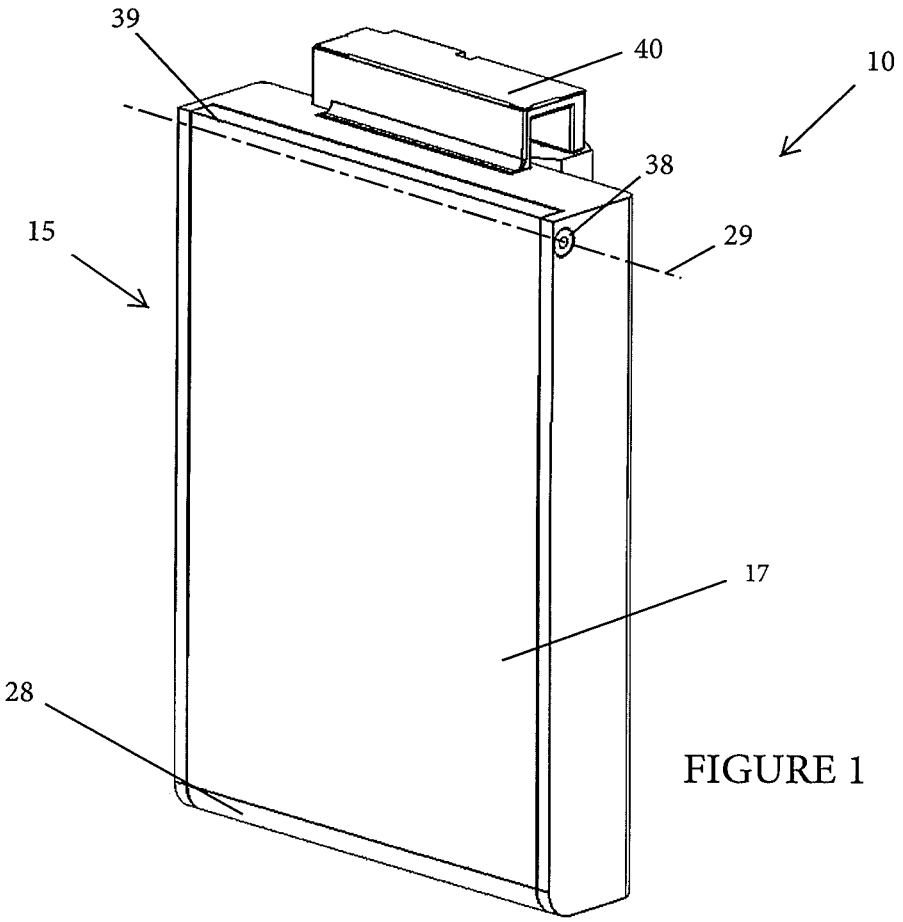
FIG. 1 is a perspective view of an automated toilet seat actuator disposed at a closed position, in accordance with a non-limiting exemplary embodiment.
Figure 2:
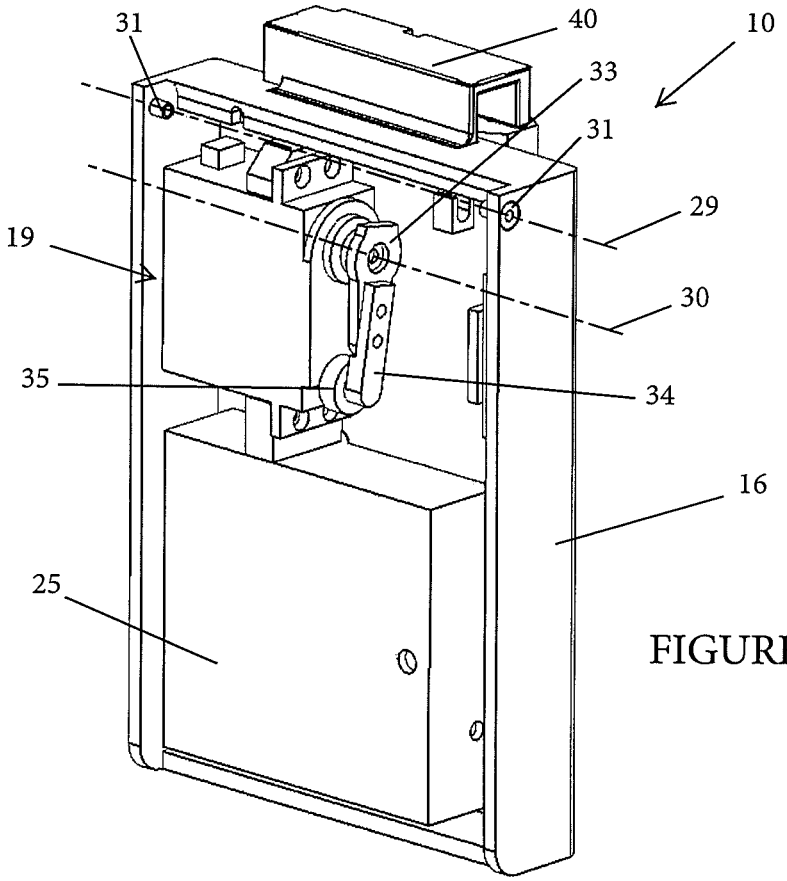
FIG. 2 is a perspective view of the automated toilet seat actuator shown in FIG. 1, wherein the cover is removed from the housing.
Figure 3:
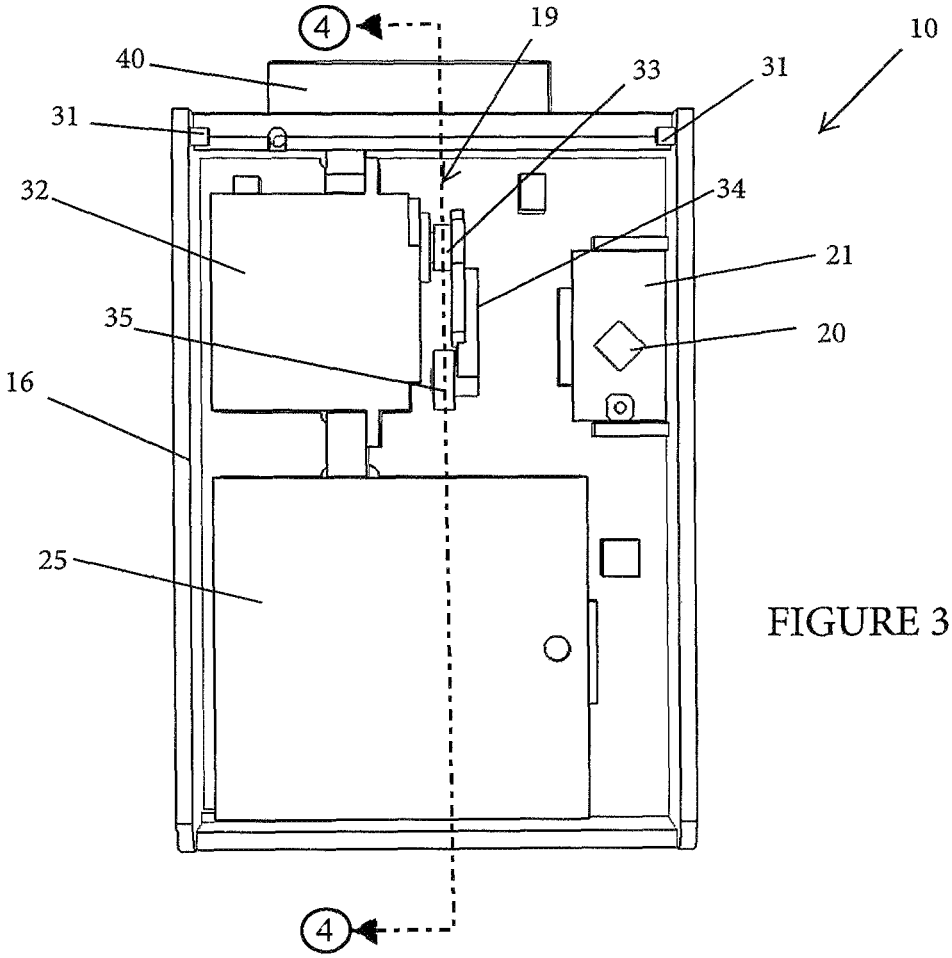
FIG. 3 is a front elevational view of the automated toilet seat actuator shown in FIG. 2.
Figure 4:
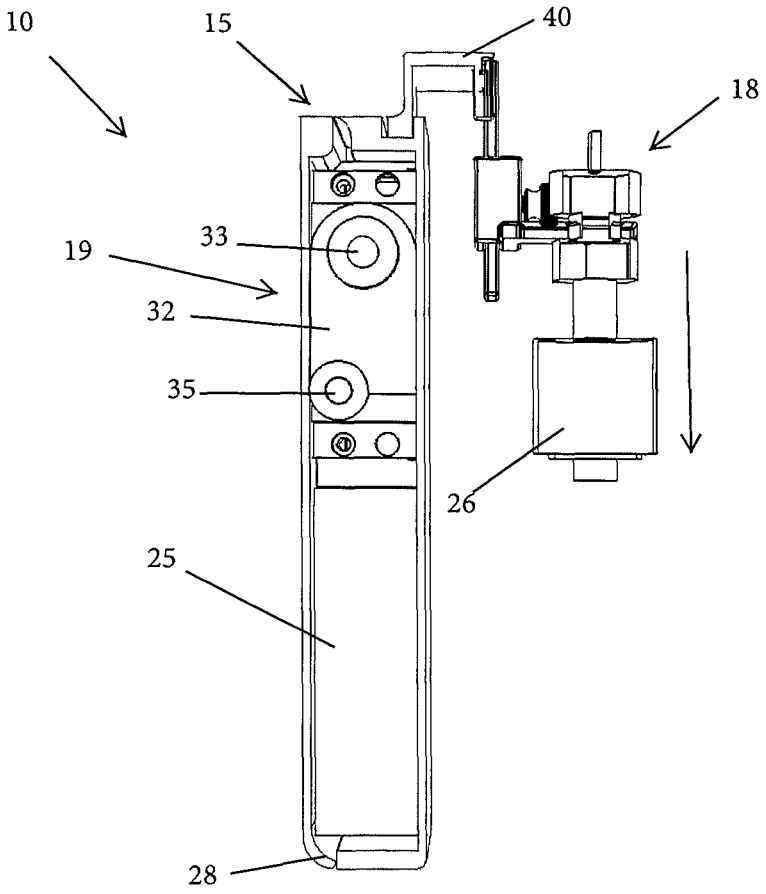
FIG. 4 is a cross-sectional view of the automated toilet seat actuator taken along line 4-4 in FIG. 3.
Figure 5:
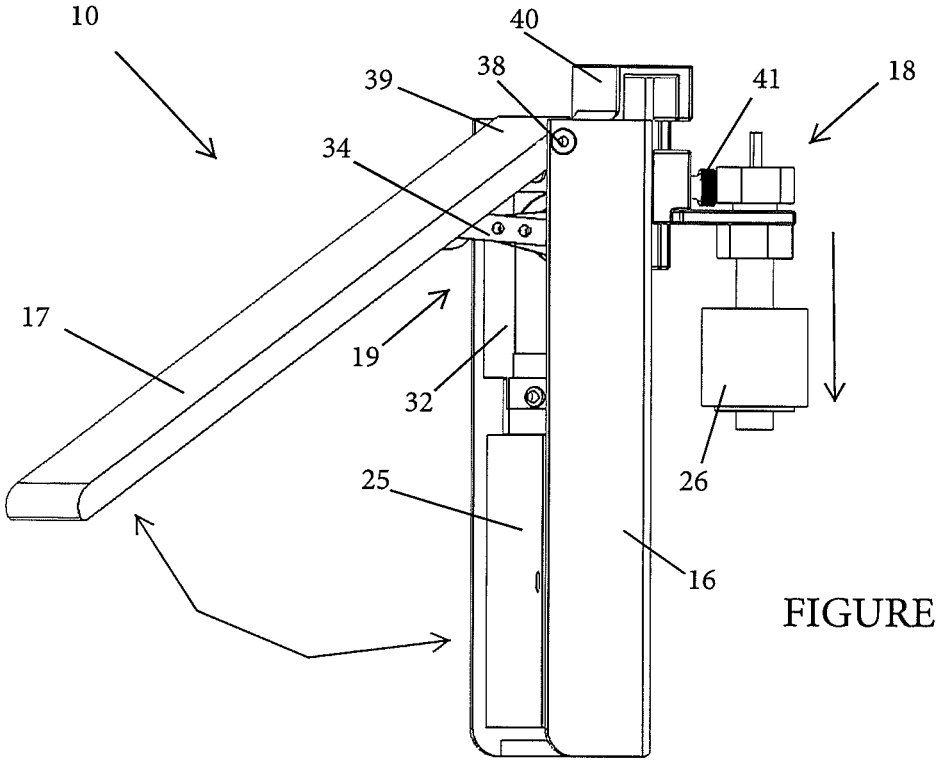
FIG. 5 is a perspective view showing the water-level detection mechanism downwardly displaced along a linear vertical path (toilet flushed), thereby causing the cover to pivot to the open position.
Figure 6:
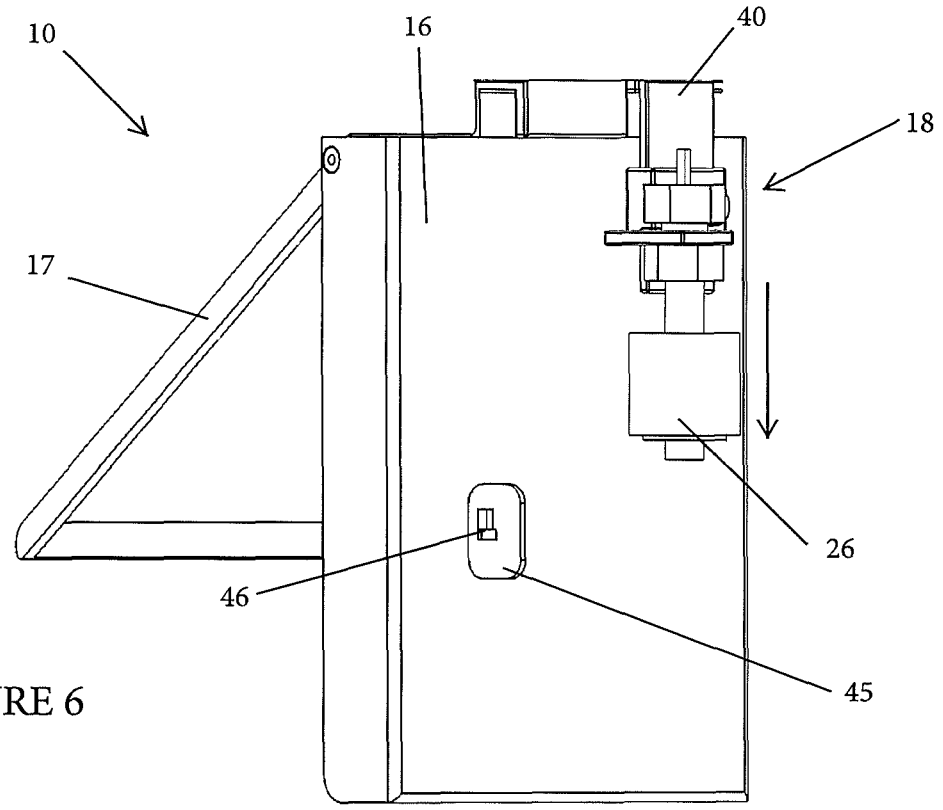
FIG. 6 is another perspective view showing a manual toggle switch located at a posterior side of the housing.
Figure 7:
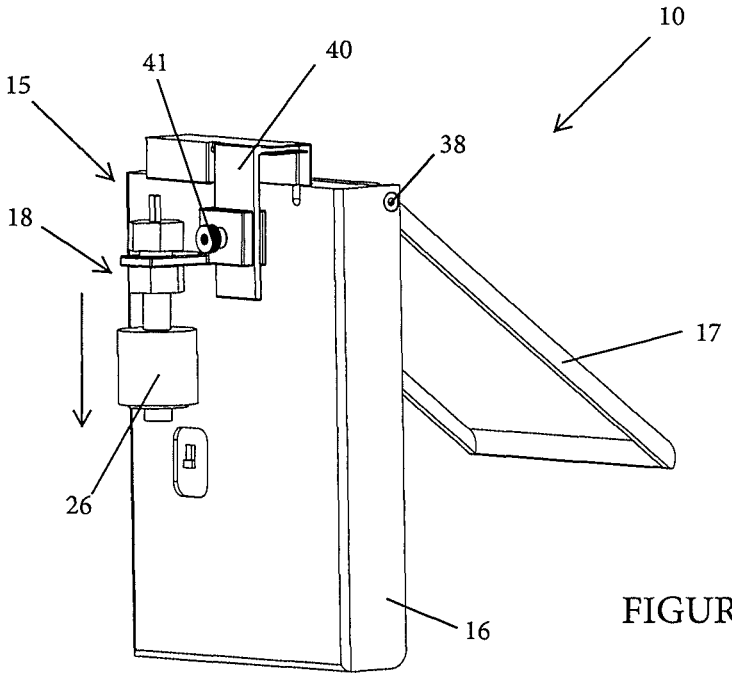
FIG. 7 is another perspective view showing the water-level detection mechanism downwardly displaced along a linear vertical path (toilet flushed), thereby causing the cover to pivot to the open position.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-13 and is/are intended to provide a portable, automated toilet seat actuator 10 that is operably positioned at a toilet tank 11 for selectively articulating a toilet seat 12 from a raised position to a lowered position when the toilet is flushed. It should be understood that the exemplary embodiment(s) may be used with a variety of toilets, and should not be limited to any particular toilet type described herein. For example, the actuator 10 may be mounted into a newly manufactured toilet tank to provide automatic closure as desired. Alternately, the actuator 10 may be retrofitted onto existing toilet tanks.

The term "actuator," "device," and like terms are interchangeably used to collectively describe the entire device 10. The term "actuation mechanism" is a single component of the "actuator". Furthermore, it is understood that the "actuator" may close both the toilet seat 12 and the toilet seat cover (if provided) at the toilet.

Referring to FIGS. 1-11 in general, in a non-limiting exemplary embodiment(s), an automated toilet seat actuator 10 includes a portable housing 15 removably engaged with the existing toilet tank 11 and includes a bottom section 16 as well as a cover 17 pivotally coupled thereto. A water-level detection mechanism 18 is located exterior of the housing 15. Such a water-level detection mechanism 18 is configured to learn when a real-time water level in the existing toilet tank 11 fluctuates below and above a predetermined minimum threshold water level (e.g., initial full tank water level). An actuation mechanism 19 is disposed within the housing 15 and is in communication with the water-level detection mechanism 18 and the existing toilet seat 12. The overall device 10 (actuator), including actuation mechanism 19, is not always in communication with the toilet seat 12. For example, if the toilet is flushed and the falling water level closes a water-level detection mechanism 18 circuit, the device 10 will actuate the cover 17 regardless if the toilet seat 12 is in the raised or lowered position. Thus, the actuation mechanism 19 is in communication with the toilet seat 12 at the raised position, and spaced from the toilet seat 12 at the lowered position.

A processor 20 is disposed within the housing 15 and is in communication with the actuation mechanism 19 and the water-level detection mechanism 18. Notably, a memory 21 is also disposed within the housing 15 and is in communication with the processor 20. Such a memory 21 includes software instructions, when executed by the processor 20, which operably bias the actuation mechanism 19 between a retracted position (e.g., initial resting position) and an extended position (e.g., subsequent displaced position) upon learning that the real-time water level has dropped below the predetermined minimum threshold water level (e.g., toilet is flushed). Advantageously, a power source 25 is entirely disposed within the housing 15 and is in communication with the actuation mechanism 19 and the processor 20.

In a non-limiting exemplary embodiment, the water-level detection mechanism 18 may include a single variable float switch 26 (VFS) wherein power use is not regulated—no sleep mode, for example.

In a non-limiting exemplary embodiment, as perhaps best shown in FIGS. 1-7 and 12, a single VFS 26 is employed, which serves as a secondary automatic switch for supplying and interrupting power to the processor 20 and servo motor 32. In particular, VFS 26 is connected in series with hard (manual) switch 46. Notably, when hard switch 46 is in the "on" position and VFS 26 is in the "on" position (closed circuit), power is supplied to the processor 20 and servo motor 32. When either switch 26, 46 is in an "off" position, power is conserved. Such a configuration of the VFS 26 with hard switch 46 provides a significant advantage. For example, it conserves power consumption between flushes because power is interrupted to the processor 20, which prevents unnecessary power usage. In particular, the in-line configuration of the VFS 26 and hard switch 46 uses power only when flushing occurs. Advantageously, various internal processes are not continuously executed at the processor 20 between flushes. Also, the power LED is not continuously illuminated between flushes. Such factors significantly preserve the power supply 25.

Figure 8:
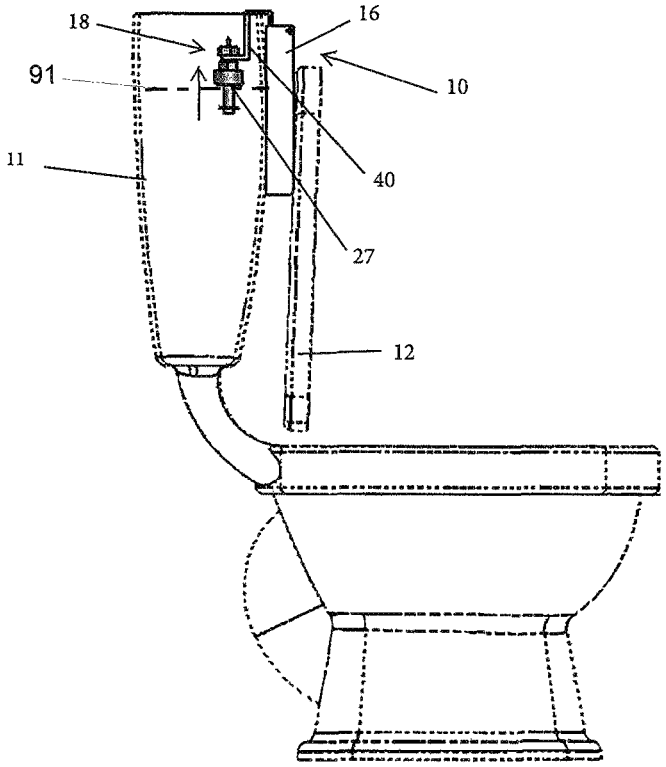
FIG. 8 is a side elevational view showing the automated toilet seat actuator (at the closed position) attached to an existing toilet.
Figure 9:
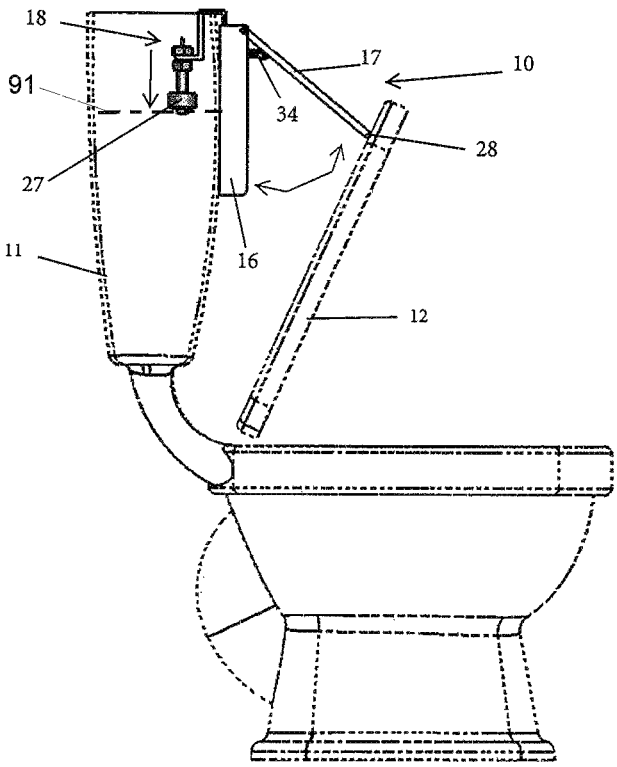
FIG. 9 is another side elevational view showing the automated toilet seat actuator (at the open position) attached to an existing toilet, thereby urging the toilet seat downward after the toilet is flushed.
Figure 10:
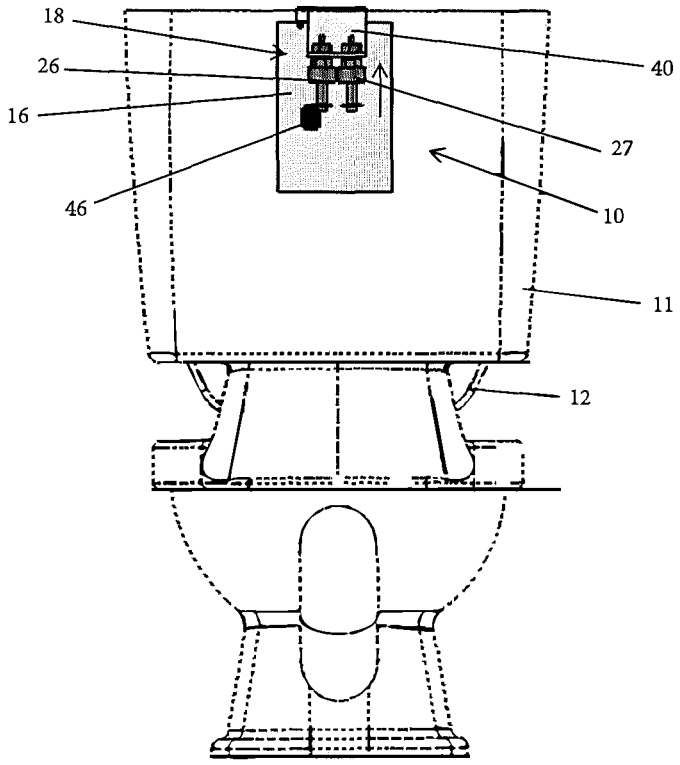
FIG. 10 is a rear elevational view showing an automated toilet seat actuator employing two variable float switches, in accordance with a non-limiting exemplary embodiment of the present disclosure.

In a non-limiting exemplary embodiment, as perhaps best shown in FIGS. 8-10, water-level detection mechanism 18 may include two or more variable float switches, 26, 27, wherein the second VFS 27 manages the power use/communication to the microprocessor 20 and actuation mechanism 19 in order to save power when the device 10 is idle (e.g., between flushes). In such a case, the power source 25 is also in communication with the water-level detection mechanism 18 (e.g., VFS 27). For example, VFS 27 serves as a switch that opens/closes a power supply circuit to the processor 20. Both VFS 26, 27 are located in the existing toilet tank 11 and exterior of housing 15.

In a non-limiting exemplary embodiment, the cover 17 has a distal end 28 provided with a radius to reduce friction/grabbing against the bottom section 16 of the housing 15. The cover 17 may pivot about a first fulcrum axis 29 on brass (or other suitably material) hinge guides 31 that can be removed if needed.

In a non-limiting exemplary embodiment, the actuation mechanism 19 is located in the housing 15 and preferably includes a servo motor 32, a servo cam 33 operably coupled to the servo motor 32, a bearing mount 34 operably coupled to the servo cam 33, and a bearing 35 operably coupled to the bearing mount 34. The servo cam 33 is rotatably displaced (articulated) about a second fulcrum axis 30 such that the bearing mount 34 and bearing 35 are generally centered at an interior face of cover 17 during articulation of the cover 17. In particular, the bearing 35 engages the interior face of cover 17 thereby pivoting it to the open position and thereafter allowing it to return to the closed position. The first fulcrum axis 29 and second fulcrum axis 30 are preferably registered parallel to each other. Notably, the bearing 35 reduces frictional contact when engaged with the cover 17. Thus, the bearing 35 and radius of the distal end 28 of the cover 17 help reduce frictional forces that lower the servo torque requirements for operably articulating the existing toilet seat 12. Such a benefit allows use of a smaller servo motor 32 and less power consumption.

In a non-limiting exemplary embodiment, the cover 17 has a plurality of axially aligned apertures 38 formed at a proximal end 39 thereof, which pivotally receive brass rivets (e.g., hinge guides 31) therethrough.

In a non-limiting exemplary embodiment, such apertures 38 may be notched thereby allowing the cover 17 to "pop off" the hinge guides 31, when an external force is urged against the cover 17 at an open position (e.g., weight of the toilet seat 12 pushing back against the opened cover 17). In this manner, the cover 17 can be easily snapped back onto the hinge guides 31 thereby alleviating a breakage problem if someone flushes the toilet tank 11 while still sitting on the toilet seat 12. For example, instead of a static mount, there could be an interference type fit where the cover 17 could safely fall off the main housing 15 without damage. This mitigates any risk of the device 10 malfunctioning/breaking and causing inconvenience if someone were to flush the toilet, and activate the device 10, while remaining seated on the toilet seat 12 during the flush cycle.

In a non-limiting exemplary embodiment, as noted above, the water-level detection mechanism 18 preferably includes at least one variable float switch 26 (VFS). The VFS 26 is connected to the bottom section 16 of the housing 15 via an adjustable mount 40 having a fastener 41 for adjustably positioning the VFS 26 at the mount 40. Such a mount 40 allows the VFS 26 to linearly reciprocate up and down relative to a stationary position of the bottom section 16. Such linear reciprocation is effectuated as the real-time water level in the toilet tank 11 falls and rises during a conventional flush cycle. As an example, the linear reciprocation may travel along a rectilinear travel path having a distance of approximately 1.25 inches. Of course, such displacement can be altered if needed.

In a non-limiting exemplary embodiment, the VFS mount 40 may be slidably and laterally positioned along a proximal end of the bottom section 16. Flexible, elongated wires (not shown) may communicatively couple the VFS 26 to the processor 20 and may be clamped to a desired edge of the existing toilet tank 11 via a conventional fastener, for example. Thus, the VFS 26 is freely situated at a user-defined height within the toilet tank 11 and is not restricted to being statically affixed to the mount 40. If both VFS 26, 27 are employed, each is tethered via respective elongated wires.

In a non-limiting exemplary embodiment, a notch 45 may be formed at the bottom section 16 of the housing 15 for accessing an on/off switch 46 of the power source 25. As noted above, if two separate VFS 26, 27 are employed, one VFS 27 may act as an additional (auxiliary) on/off switch for the power source 25. Such an embodiment extends the useful life of the power source 25. In the dual VFS embodiment, VFS 27 acts like a switch and closes a circuit between the microprocessor 20 and power source 25, thereby enabling power to flow therebetween, and VFS 26 activates the actuation mechanism 19 to lower the toilet seat 12. When the toilet tank 11 refills with water, one or both VFS 26, 27, respectively, can turn off the microprocessor 20 and reset the actuation mechanism 19 for the next flush. In this manner, the device 10 may enter a sleep mode and reduce power consumption between flushes.

In a non-limiting exemplary embodiment, the power source 25 may include 4 AA batteries. Of course, other suitable batteries may be employed.

In a non-limiting exemplary embodiment, power consumption may be managed by programming the processor 20 and actuation mechanism 19 to operate in a low-power (sleep) mode. In a normal operating mode, (i.e., active mode), the processor 20 may continuously execute instructions that monitor a variety of operating parameters of the water-level detection mechanism 18, servo motor 32, timer, voltage levels, etc. In addition, the processor 20 has a variety of onboard components that are constantly monitored and/or powered, such as an analog to digital converter, a serial peripheral interface, and a watchdog timer, for example. Thus, the sleep mode may be employed to reduce overall power consumption by not continuously executing such instructions. In this manner, while in the sleep mode, selected functions can be "turned off" for unused peripherals. Use of sleep mode requires a defined "wake-up" schedule, or signal from remaining active peripherals, in order to execute desired instructions/functions to operate the device 10. The "wake-up" schedule should have suitable intervals that ensure all water-level detection mechanism 18 linear reciprocation signals are received and learned during each flush cycle.

In a non-limiting exemplary embodiment, a power LED may be disabled to conserve power. Such a function may be accomplished via hardware modification. If the processor 20 board is manufactured with the power/status LED, software modification may not be suitable and more permanent hardware modification may be required.

In a non-limiting exemplary embodiment, power consumption may be further mitigated by replacing/removing the voltage regulator. The on-board regulator of the processor 20 is efficient at our range of load (~50 mA drain on an average AA battery) but could be removed to further reduce power consumption.

In a non-limiting exemplary embodiment, the processor 20 may be a microprocessor such as a processor having the ARDUINO™ based platform (https://www.arduino.cc/). Such a processor 20 has flexible hardware and software programming for a variety of applications. The software instructions of the present disclosure automate the closing of a toilet lid and/or seat 12 after a toilet is flushed. Some of the control logic algorithm was developed and written in the ARDUINO™ Integrated Development Environment (IDE). The IDE utilizes the common programming languages of C and C++ architecture. It is noted that the ARCUINO™ IDE is not intended to be limiting. One skilled in the art understands that a variety of customized software programs may be written in a variety of IDEs, and executed via a variety of processors, without departing from the true spirit and scope of the present disclosure.

In a non-limiting exemplary embodiment, automating the closing of the toilet lid and/or seat 12 after a flush, utilizes the toilet tank 11 water level. This allows the present disclosure to be retrofitted onto a variety of existing toilets that utilize a volume of water in the flush cycle. One or more of the employed VFS 26 and/or 27 detect and learn the real-time water level at the beginning and end of the toilet flush cycle. An exemplary VFS is preferably formed from polypropylene to resist corrosion and is suitable for use in the toilet tank 11 water system. It is noted that stainless steel and/or plastic versions of the VFS may be employed without departing from the true spirit and scope of the present disclosure.

In a non-limiting exemplary embodiment, each VFS has a first extreme position that creates an open condition in the circuit and a second opposed extreme position that causes the circuit to be closed (or complete). The VFS could be normally open (NO) or normally closed (NC) depending on the orientation of the VFS mount 40. The present disclosure can utilize a VFS in either condition for the intended use, the initial condition of the VFS simply needs to be known.

Figure 11:
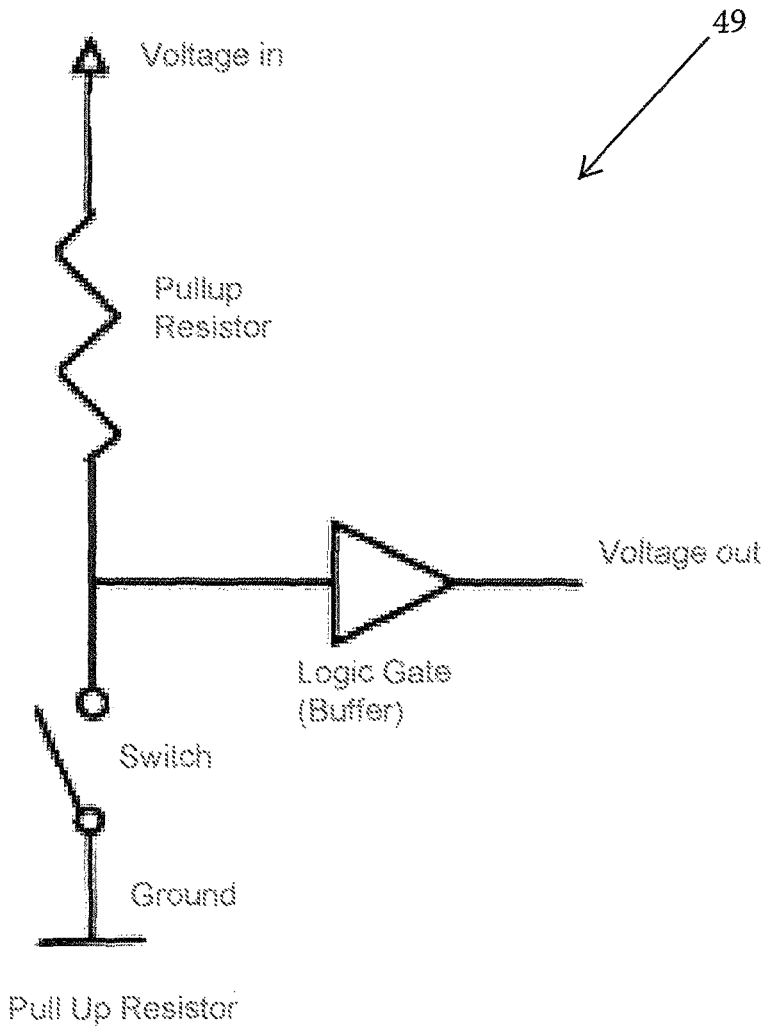
FIG. 11 is an electrical schematic diagram showing the interrelationship between the main components of a pull up resistor, employed by a non-limiting exemplary embodiment of the present disclosure.
Figure 12:
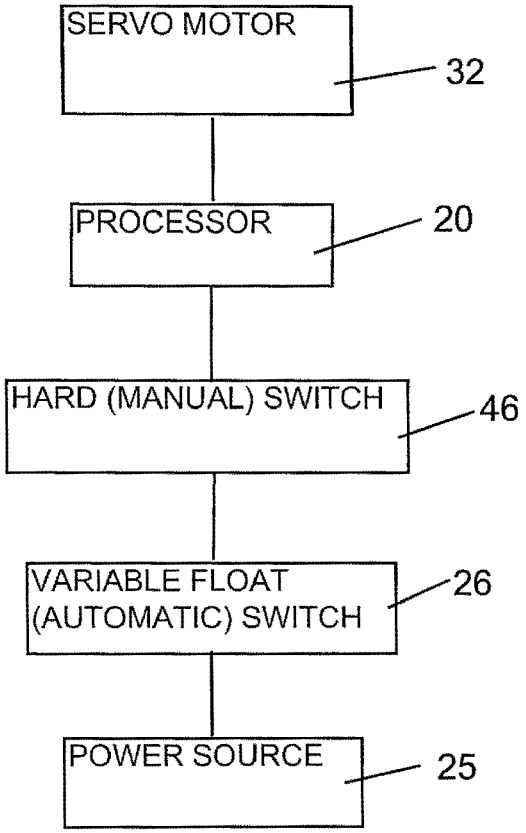
FIG. 12 is a high level schematic block diagram showing the interrelationship between the manual and automatic switches, employed by a non-limiting exemplary embodiment of the present disclosure.
Figure 13:
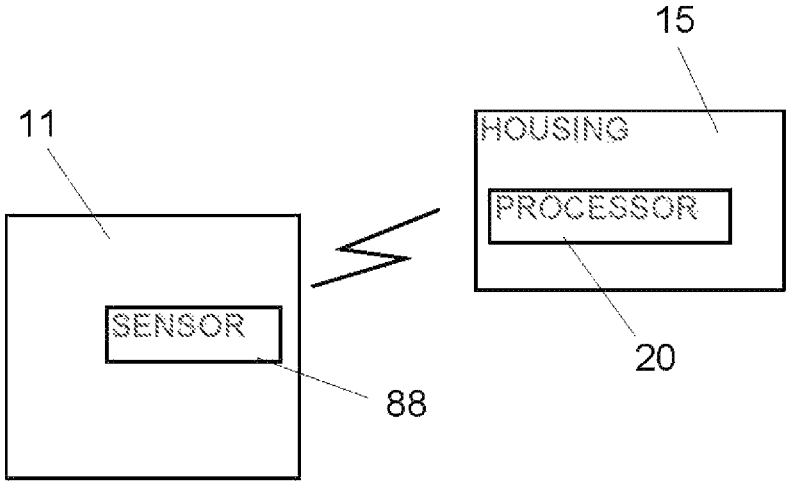
FIG. 13 is a high level schematic block diagram showing the interrelationship between a sensor and the processor, employed by a non-limiting exemplary embodiment of the present disclosure.

In a non-limiting exemplary embodiment, as perhaps best shown in FIG. 11, a "pull-up" circuit 49 is employed where the VFS is mounted in a NO initial condition. A pull-up resistor weekly "pulls" the voltage of the wire to which it is connected, towards its voltage source level when the other components on the line are inactive. For example, 10 k Ohm resistor is utilized between the VFS, the system voltage, and the logic gate. When the switch on the line is open (meaning the VFS is in the NO state), it is high-impedance and acts like it is disconnected. The pull-up resistor assures that the wire is at a defined logic level even if no active loads are connected to it. Of course, one skilled in the art understands such a customized software program's control logic algorithm may be configured in a variety of ways to identify triggering events and execute unique steps for initiating and/or resetting the actuation mechanism 19.

In a non-limiting exemplary embodiment, the software instructions have a built-in timer that checks the status of the pull-up circuitry every 30 seconds (or other interval as needed). If the pull-up circuit still appears "disconnected," then the VFS is still in the NO state (meaning the water tank is full and/or at the same initial level—not flushed) and no action occurs from the device 10. If during the check, the VFS moves to the closed state, then the logic gate commands a servo motor 32 function to slowly open and articulate the door (cover 17) to an open position. The servo function is designed to have a cycle time of approximately 15 seconds and precisely controls the speed and positioning. Once the servo cycle is completed, the software restarts the 30 second timer and the process may begin again. Thus, the cover 17 is articulated back to a closed position at the housing 15.

In the dual VFS embodiment, one VFS preferably toggles the device 10 between a sleep mode and an active mode. The other VFS preferably notifies the processor 20 when to operate the actuation mechanism 19.

In a non-limiting exemplary embodiment, a mercury tilt switch may be positioned inside the toilet tank 11. As the water level falls during a flush cycle, the mercury tilt switch closes the circuit to the processor. Then, the rising water opens the circuit for the next flush cycle.

In a non-limiting exemplary embodiment, a motion sensor may be located inside the toilet tank 11. Such a sensor detects the falling water level and causes the circuit to close. The sensor then reopens the processor circuit as the toilet tank 11 refills.

In a non-limiting exemplary embodiment, the housing 15 may have a powered, telescopic cam actuation mechanism. Such a telescopic cam actuation mechanism may be centrally located and suspended from a top of the toilet tank 11. Several telescoping sections are compactly interfitted inside each other until flushing occurs. During a flush cycle, the falling water level closes the circuit (via, for example, VFS, mercury tilt switch, motion sensor, etc.) to the processor, thereby causing such telescoping sections to extend horizontally a predetermined distance (e.g., 5.75 inches) and push the raised toilet seat past vertical orientation away from the toilet tank 11. Consequently, gravity completes the lowering of the toilet seat. The toilet tank 11 refills with water and the battery circuit is closed after the telescoping sections return to their original retracted position, ready for the next flush cycle.

In a non-limiting exemplary embodiment, the water-level detection mechanism 18 is adjustably tethered to the processor 20. For example, the VFS 26 may be tethered to the processor 20 via a flexible communications cable (not shown) that can be adjustably clipped to various positions along a top edge of the toilet tank 11 for adequately reaching the water level 91 therein, as needed.

In a non-limiting exemplary embodiment, the water-level detection mechanism 18 may include a sensor 88 in communication with the processor 20. Such a sensor 88 is capable of determining when a water level 91 in the toilet tank 11 rises and falls during a flush cycle. For example, one or more sensor(s), such as a motion and/or light sensor(s) may be provided to cause the present disclosure to detect an event, for example flushing a toilet (rise/fall of water level 91 in toilet tank 11). Active and/or passive sensors may be used to react to detectable event such as light, noise, radiation (e.g., heat), or changes in emitted energy, fields or beams. However, the disclosure is not limited to a particular type of sensor. Those skilled in the art will appreciate that other sensors may be used without departing from the scope of the disclosure. Examples of such other sensors include optical sensors configured to sense light; microwave sensors that use a Gunn diode operating within pre-set limits to transmit/flood a designated area/zone with an electronic field whereby movement in the zone disturbs the field and sets off an alarm; an ultrasonic sensor configured to react to a determined range of ultrasonic sound energy in a protected area; or any other sensor capable of providing motion detection capability in accordance with principles of the disclosure.

In a non-limiting exemplary embodiment, the cover 17 is detachably coupled to the housing 15 so that if a user accidentally leans back against the cover 17 during opening movement, the user's external force against the cover 17 will not damage the internal components. Rather, the cover 17 will simply snap off and can be reattached as explained hereinabove.

In a non-limiting exemplary embodiment, the water-level detection mechanism 18 includes a variable float switch 26 communicatively coupled to the processor 20. Such a variable float switch 26 is capable of being seated within the existing toilet tank 11 at a horizontal water level 91 (before flushing).

In a non-limiting exemplary embodiment, the variable float switch 26 linearly reciprocates along a vertical travel path (as identified by the directional arrows in FIGS. 4-10) relative to the horizontal water level 91 within the existing toilet tank 11.

In a non-limiting exemplary embodiment, the cover 17 pivots about a first fulcrum axis 29 relative to a stationary position of the bottom section 16 of the housing 15. Such an actuation mechanism 19 includes: a servo motor 32 and a servo cam 33 operably coupled thereto, a bearing mount 34 operably coupled to the servo cam 33, and a bearing 35 operably coupled to the bearing mount 34. In this manner, the servo cam 33 is rotatably displaced (articulated) about a second fulcrum axis 30 such that the bearing mount 34 and bearing 35 are generally centered at an interior face of cover 17 during articulation of the cover 17. In particular, the bearing 35 engages the interior face of cover 17 thereby pivoting it to the open position and thereafter allowing it to return to the closed position.

In a non-limiting exemplary embodiment, the first fulcrum axis is registered parallel to the second fulcrum axis.

In a non-limiting exemplary embodiment, the water-level detection mechanism 18 is statically coupled to the bottom section 16 of the housing 15.

In a non-limiting exemplary embodiment, the water-level detection mechanism 18 is adjustably tethered to the processor 20 inside the housing 15.

The present disclosure further includes a method of utilizing an automated toilet seat 12 actuator 10 for selectively articulating an existing toilet seat 12 from a raised position to a lowered position when an existing toilet tank 11 is flushed. Such a method includes the steps of: obtaining an existing toilet tank 11; and providing and operably positioning an automated toilet seat 12 actuator 10 at the existing toilet tank 11 by performing the sub-steps of: providing a portable housing 15 including a bottom section 16 and a cover 17 pivotally coupled thereto; providing and locating a water-level detection mechanism 18 exterior of the housing 15; providing and disposing an actuation mechanism 19 within the housing 15 such that the actuation mechanism 19 is in communication with the water-level detection mechanism 18 and the existing toilet seat 12; providing and disposing a processor 20 within the housing 15 such that the processor 20 is in communication with the actuation mechanism 19 and the water-level detection mechanism 18; providing and disposing a memory 21 within the housing 15 such that the memory 21 is in communication with the processor 20; providing and disposing a power source 25 within the housing 15 such that the power source 25 is in communication with the actuation mechanism 19 and the processor 20; and removably engaging the portable housing 15 with the existing toilet tank 11.

The method further includes the steps of: flushing the existing toilet tank 11; the water-level detection mechanism 18 learning when a real-time water level 91 in the existing toilet tank 11 fluctuates below and above a predetermined minimum threshold water level; and the memory 21 including software instructions, when executed by the processor 20, operably biasing the actuation mechanism 19 between a retracted position and an extended position upon learning that the real-time water level 91 has dropped below the predetermined minimum threshold water level.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. An automated toilet seat actuator operably positioned at an existing toilet tank for selectively articulating an existing toilet seat from a raised position to a lowered position when the existing toilet tank is flushed, said automated toilet seat actuator comprising:

a housing engaged with the existing toilet tank and including a bottom section and a cover pivotally coupled thereto;

a water-level detection mechanism located exterior of said housing, said water-level detection mechanism being configured to learn when a real-time water level in the existing toilet tank fluctuates below and above a predetermined minimum threshold water level;

an actuation mechanism disposed within said housing and being in communication with said water-level detection mechanism and the existing toilet seat;

a processor disposed within said housing and being in communication with said actuation mechanism and said water-level detection mechanism;

a memory disposed within said housing and being in communication with said processor, said memory including software instructions, when executed by said processor, which operably bias said actuation mechanism between a retracted position and an extended position upon learning that the real-time water level has dropped below said predetermined minimum threshold water level; and a power source in communication with said actuation mechanism and said processor;

wherein said cover pivots about a first fulcrum axis relative to said bottom section, said actuation mechanism comprises a servo motor and a servo cam operably coupled thereto;

a bearing mount operably coupled to said servo cam; and a bearing operably coupled to said bearing mount wherein said servo cam is displaced about a second fulcrum axis such that said bearing cam and said bearing are generally centered at an interior face of said cover during articulation of said cover.

2. The automated toilet seat actuator of claim 1, wherein said cover is detachably coupled to said housing.

3. The automated toilet seat actuator of claim 1, wherein said water-level detection mechanism comprises: a variable float switch communicatively coupled to said processor, said variable float switch capable of being seated within the existing toilet tank.

4. The automated toilet seat actuator of claim 3, wherein said variable float switch linearly reciprocates along a vertical travel path relative to a horizontal water level within the existing toilet tank.

5. The automated toilet seat actuator of claim 1, wherein said water-level detection mechanism comprises: a sensor in communication with said processor, said sensor being capable of determining when a water level in the toilet tank rises and falls.

6. The automated toilet seat actuator of claim 1, wherein said first fulcrum axis is registered parallel to said second fulcrum axis.

7. The automated toilet seat actuator of claim 1, wherein said water-level detection mechanism is statically coupled to said bottom section.

8. The automated toilet seat actuator of claim 1, wherein said water-level detection mechanism is adjustably tethered to said processor.

9. An automated toilet seat actuator operably positioned at an existing toilet tank for selectively articulating an existing toilet seat from a raised position to a lowered position when the existing toilet tank is flushed, said automated toilet seat actuator comprising:

a portable housing removably engaged with the existing toilet tank and including a bottom section and a cover pivotally coupled thereto;

a water-level detection mechanism located exterior of said housing, said water-level detection mechanism being configured to learn when a real-time water level in the existing toilet tank fluctuates below and above a predetermined minimum threshold water level;

an actuation mechanism disposed within said housing and being in communication with said water-level detection mechanism and the existing toilet seat;

a processor disposed within said housing and being in communication with said actuation mechanism and said water-level detection mechanism;

a memory disposed within said housing and being in communication with said processor, said memory including software instructions, when executed by said processor, which operably bias said actuation mechanism between a retracted position and an extended position upon learning that the real-time water level has dropped below said predetermined minimum threshold water level; and a power source disposed within said housing and being in communication with said actuation mechanism and said processor;

wherein said cover pivots about a first fulcrum axis relative to said bottom section, said actuation mechanism comprises a servo motor and a servo cam operably coupled thereto;

a bearing mount operably coupled to said servo cam; and a bearing operably coupled to said bearing mount;

wherein said servo cam is displaced about a second fulcrum axis such that said bearing cam and said bearing are generally centered at an interior face of said cover during articulation of said cover.

10. The automated toilet seat actuator of claim 9, wherein said cover is detachably coupled to said housing.

11. The automated toilet seat actuator of claim 9, wherein said water-level detection mechanism comprises: a variable float switch communicatively coupled to said processor, said variable float switch capable of being seated within the existing toilet tank.

12. The automated toilet seat actuator of claim 11, wherein said variable float switch linearly reciprocates along a vertical travel path relative to a horizontal water level within the existing toilet tank.

13. The automated toilet seat actuator of claim 9, wherein said water-level detection mechanism comprises: a sensor in communication with said processor, said sensor being capable of determining when a water level in the toilet tank rises and falls.

14. The automated toilet seat actuator of claim 9, wherein said first fulcrum axis is registered parallel to said second fulcrum axis.

15. The automated toilet seat actuator of claim 9, wherein said water-level detection mechanism is statically coupled to said bottom section.

16. The automated toilet seat actuator of claim 9, wherein said water-level detection mechanism is adjustably tethered to said processor.

17. A method of utilizing an automated toilet seat actuator for selectively articulating an existing toilet seat from a raised position to a lowered position when an existing toilet tank is flushed, said method comprising the steps of:

obtaining an existing toilet tank;

providing and operably positioning an automated toilet seat actuator at the existing toilet tank by performing the sub-steps of providing a portable housing including a bottom section and a cover pivotally coupled thereto, providing and locating a water-level detection mechanism exterior of said housing, providing and disposing an actuation mechanism within said housing such that said actuation mechanism is in communication with said water-level detection mechanism and the existing toilet seat, providing and disposing a processor within said housing such that said processor is in communication with said actuation mechanism and said water-level detection mechanism, providing and disposing a memory within said housing such that said memory is in communication with said processor, providing and disposing a power source within said housing such that said power source is in communication with said actuation mechanism and said processor, and removably engaging said portable housing with the existing toilet tank; flushing the existing toilet tank;

said water-level detection mechanism learning when a real-time water level in the existing toilet tank fluctuates below and above a predetermined minimum threshold water level; and said memory including software instructions, when executed by said processor, operably biasing said actuation mechanism between a retracted position and an extended position upon learning that the real-time water level has dropped below said predetermined minimum threshold water level;

wherein said cover pivots about a first fulcrum axis relative to said bottom section, said actuation mechanism comprises a servo motor and a servo cam operably coupled thereto;

a bearing mount operably coupled to said servo cam; and a bearing operably coupled to said bearing mount;

wherein said servo cam is displaced about a second fulcrum axis such that said bearing cam and said bearing are generally centered at an interior face of said cover during articulation of said cover.

* * * * *